United States Patent [19]

Kojima et al.

[11] Patent Number: 4,917,326

[45] Date of Patent: Apr. 17, 1990

[54] FLUFF SCATTERING PREVENTING DEVICE IN WINDER

[75] Inventors: Toshiaki Kojima, Kyoto; Hiroshi Uchida, Oumihachiman; Yasuhiko Kubota, Nagaokakyo, all of Japan

[73] Assignee: Murata Kikai Kabushiki Kaisha, Kyoto, Japan

[21] Appl. No.: 180,909

[22] Filed: Apr. 13, 1988

[30] Foreign Application Priority Data

Apr. 15, 1987 [JP] Japan ..... 62-92897
Jul. 22, 1987 [JP] Japan ..... 62-112481

[51] Int. Cl.[4] ..... B65H 49/00; B65H 57/22

[52] U.S. Cl. ..... 242/128; 57/354; 242/35.5 R; 242/35.6 E

[58] Field of Search ..... 242/128, 35.5 R, 35.5 A, 242/35.6 R, 35.6 E, 18 R, 54 R; 57/304, 305, 354, 355, 356, 357

[56] References Cited

U.S. PATENT DOCUMENTS

| | | | |
|---|---|---|---|
| 2,745,239 | 5/1956 | Kingsbury | 57/354 |
| 2,994,491 | 8/1961 | Weber | 242/128 |
| 3,011,736 | 12/1961 | Furst et al. | 242/128 |
| 3,065,592 | 11/1962 | Kresslein | 57/357 |
| 3,076,304 | 2/1963 | Fisher | 57/356 |
| 3,094,835 | 6/1963 | Nimtz et al. | 57/354 |
| 3,236,464 | 2/1966 | Wey | 242/35.6 E X |
| 3,295,776 | 1/1967 | Cruickshank et al. | 242/35.6 E X |
| 3,718,296 | 2/1973 | Mahoney et al. | 242/128 X |
| 3,807,159 | 4/1974 | Hamel | 242/128 X |
| 4,673,138 | 6/1987 | Ichiba | 242/35.5 R |

*Primary Examiner*—Stanley N. Gilreath
*Attorney, Agent, or Firm*—Spensley Horn Jubas & Lubitz

[57] ABSTRACT

In a winder, a cover is provided at a portion of the winder where fluff is very likely to occur; that is, the portion is the position of a yarn feed bobbin, and the cover operates to cover this portion, thereby enclosing the fluff therein, and a suction pipe is connected to a part of the cover to discharge the fluff by suction.

9 Claims, 7 Drawing Sheets

FLUFF SCATTERING PREVENTING DEVICE IN WINDER

FIELD OF THE INVENTION

The present invention relates to a fluff scattering preventing device in a winder.

RELATED ART STATEMENT

For the removal of fluff in a winder there have been proposed various devices, including a device wherein a car having a depending, cleaning pipe such as a suction pipe or a blow-off pipe is reciprocated along a ceiling rail disposed above the winder, and a device utilizing air curtain such as that shown in Japanese Patent Publication No. 6779/76.

In any of the above devices it is difficult to effect a complete removal of fluff produced in the winder. In the use of the moving cleaning pipe, the winding unit is cleaned only intermittently, that is, the effect of the cleaning is extremely unsatisfactory. On the other hand, in the device wherein a band-like air current is ejected concentratively from above the winder toward the front of the winding unit, like air curtain, the air pressure is diffused and reduced in the vicinity of the yarn feed bobbin located in a lower position where fluff is most likely to be produced, so that a large quantity of fluff from the bobbin is scattered into the atmospheric air, thus causing pollution of the air in the factory.

In an automatic winder, yarn which is rewound and drawn out from a yarn feed bobbin passes through a balloon guide called a balloon breaker, then travels through upper tenser, slub catcher, etc. and is wound up to a package being rotated by a traverse drum.

As such balloon guide there is used, for example, a balloon guide of the type wherein balloon is throttled at one point, or a mere cylindrical type having a certain length.

OBJECT AND SUMMARY OF THE INVENTION

It is an object of the present invention to provide a device capable of discharging fluff from a winder in an extremely effective manner.

According to the illustrated embodiment of the present invention, a cover is provided at a portion where fluff is very likely to occur, that is, the position of a yarn feed bobbin, to cover this portion, thereby enclosing the fluff therein, and a suction pipe is connected to a part of the cover to discharge the fluff by suction.

The cover of the present invention may be provided with a balloon guide at inner portion of the cover. The balloon guide is formed with a tapered throttling portion in a predetermined internal position of a cylindrical body.

DETAILED DESCRIPTION OF PREFERRED EMBODIMENTS

Figure 9:
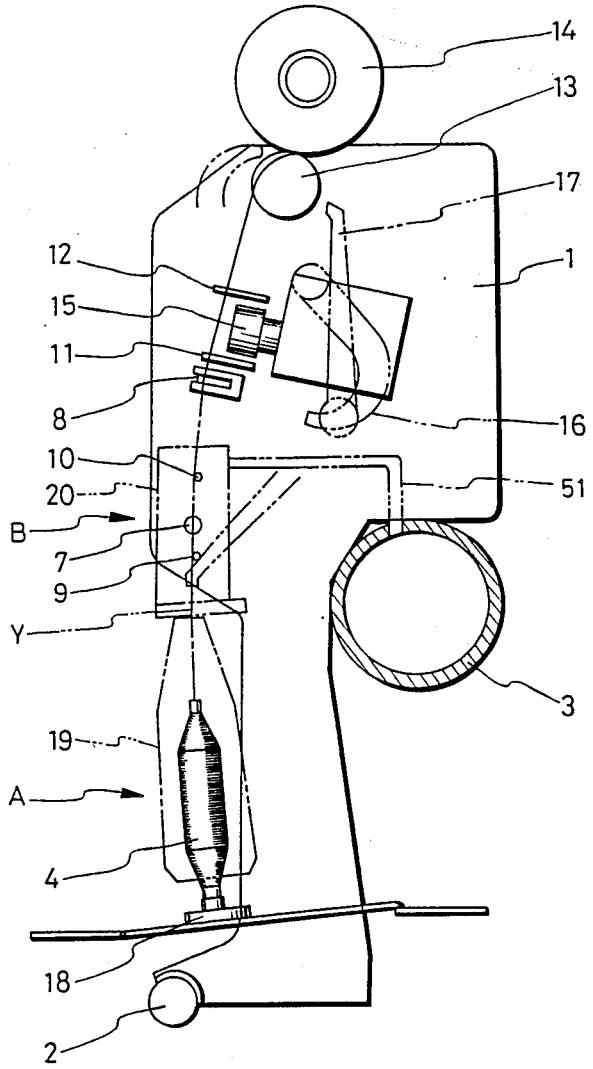
FIG. 9 is a schematic side view showing an example of construction of a winding unit.

FIG. 9 shows an example of a winding unit. The winding unit, indicated at 1, is held in place by a support pipe 2 and a suction pipe 3. A yarn feed bobbin 4 is brought into a predetermined position in the winding unit, and yarn Y, which is drawn out from the bobbin 4, passes through a tenser 7 and a slub catcher 8 along guides 9, 10, 11 and 12 and is wound up to a take-up package 14 which is rotated by a traverse drum 13. Numeral 15 denotes a yarn joining device; numeral 16 denotes a suction mouth for guiding the yarn on the package side to the yarn joining device 15; and numeral 17 denotes a relay pipe for guiding the yarn on the feed bobbin side to the yarn joining device 15. Each winding unit is provided with these components. A large number of such winding units 1 are arranged side by side to constitute one automatic winder.

Various methods are adoptable for supplying the yarn feed bobbin 4 to the predetermined position in the winding unit 1. In this embodiment there is shown a winder of the type in which the feed bobbin 4 is fitted upright on one of bobbin trays 18 which are independent of each other, and in this state the bobbin is conveyed to the winding unit, followed by winding and discharge from the unit. Of course, various types of winders are employable, including a winder wherein each winding unit has a magazine for storing plural bobbins, and a winder wherein, unlike the above, each winding unit is not a fixed type but circulates along an elliptical path.

Figure 1:
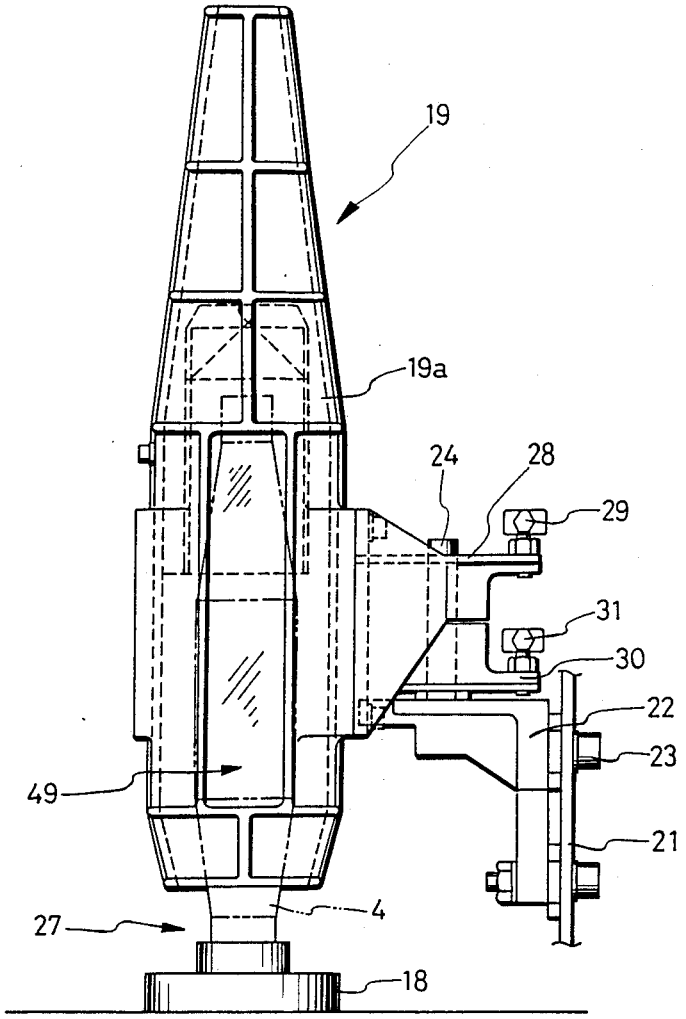
FIG. 1 is a front view showing an embodiment of the device of the present invention.

In the case where a bobbin after spinning from a ring spinning frame, or a spinning bobbin, is used as the yarn feed bobbin in FIG. 1, a large quantity of fluff is produced at a yarn rewinding portion A or at a tenser portion B due to contact between yarn portions or contact between the yarn and the tenser portion. In such fluffing portions there are provided covers 19 and 20 to cover those portions.

The following description is now provided about covers for the bobbin with reference to FIGS. 1 to 6.

Figure 2:
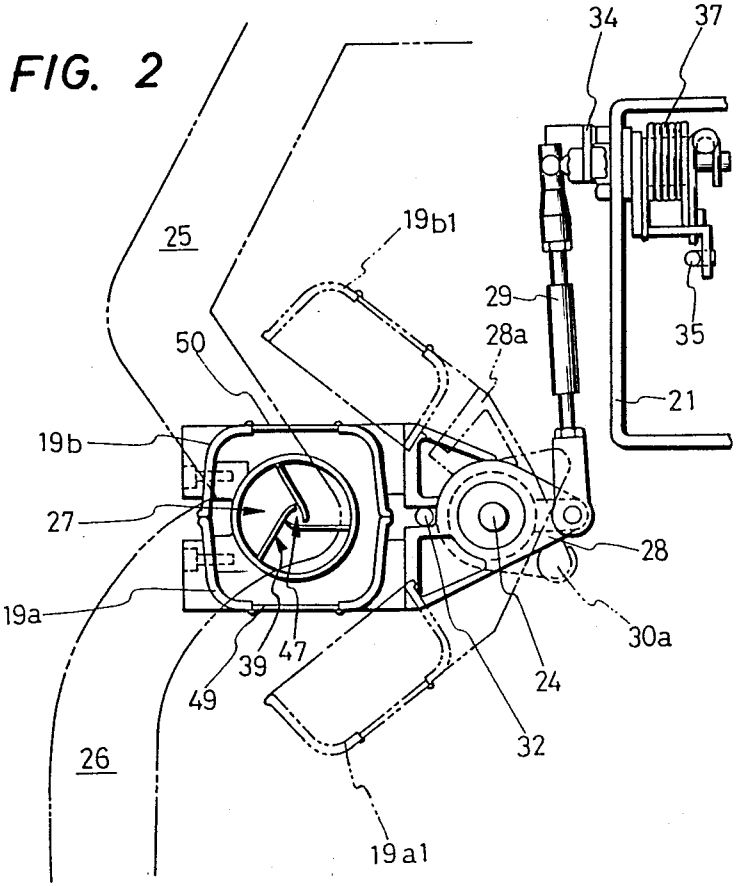
FIG. 2 is a plan view thereof.
Figure 4:
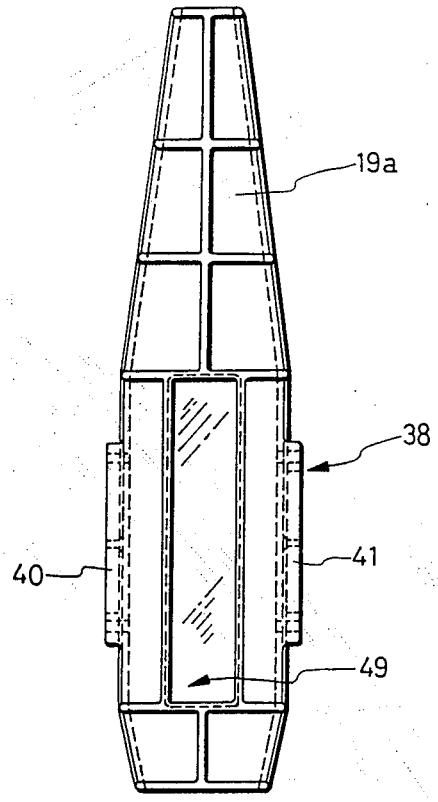
FIG. 4 is a front view of a cover body.
Figure 5:
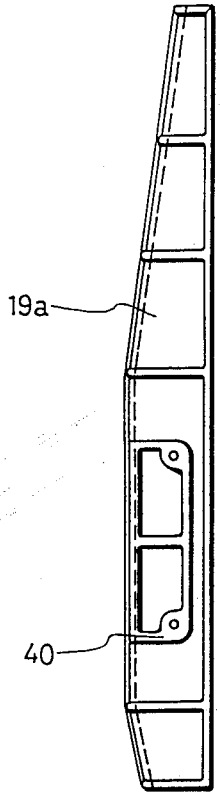
FIG. 5 is a side view thereof.
Figure 6:
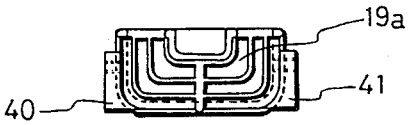
FIG. 6 is a plan view thereof.
Figure 7:
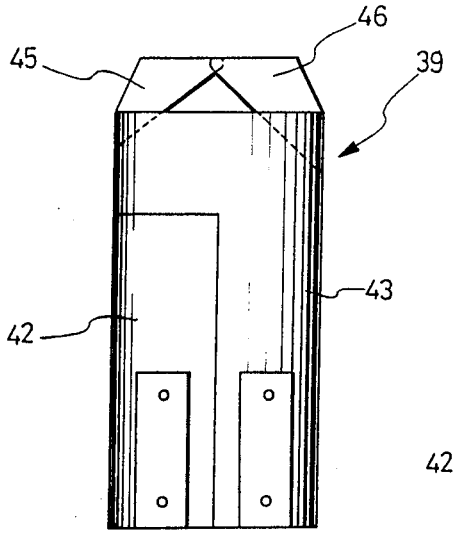
FIG. 7 is a front view of a balloon guide.
Figure 8:
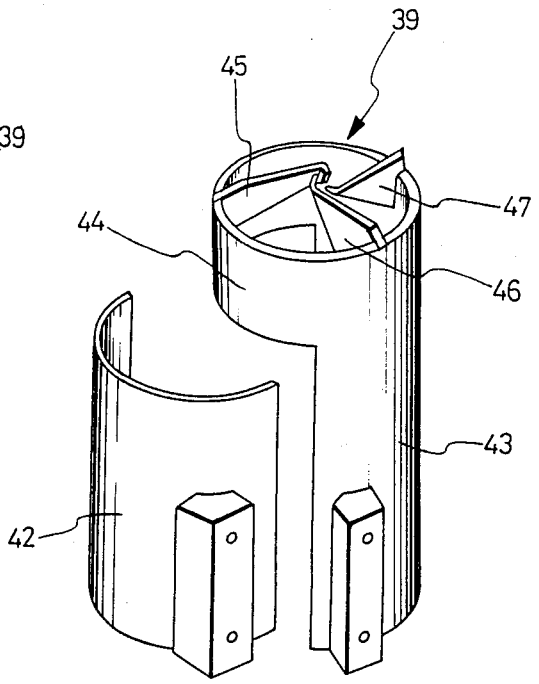
FIG. 8 is a perspective view thereof.

In FIGS. 1 and 2, a bracket 22 is fixed with bolts 23 to a frame 21 of the winding unit and a pair of covers **19*a* and 19*b* are connected to the bracket 22 through a shaft 24** pivotably for opening and closing motion.

In a closed state the covers **19*a* and 19*b* are in a generally square shape in plan view as in FIG. 2, while in an open position indicated by dash-double dot lines 19*al* and 19*bl* the covers are spaced away from bobbin passages 25 and 26, providing no obstacle to the discharge of the bobbin from the take-up position and taking-in of a new bobbin to the take-up position indicated at 27**.

Such a square shape in transverse section of covers **19*a* and 19*b* as in FIG. 2** is advantageous in that a rising air current is easily developed in the gap of each corner portion and so fluff rises smoothly Further, the contact of ballooning yarn with the cover is less than that with a cylindrical cover, so the resistance and damage to the yarn are reduced.

One cover 19a is fixed to a pivotable member 28 which is pivotally supported by the fixed shaft 24, and an actuating rod 29 is connected to one end of the pivotable member 28. Likewise, the other cover 19b is fixed to a pivotable member 30 which is pivotally supported by the shaft 24, and a rod 31 is connected thereto. Numeral 32 denotes a stopper for defining the closed positions of the covers 19a and 19b.

Figure 3:
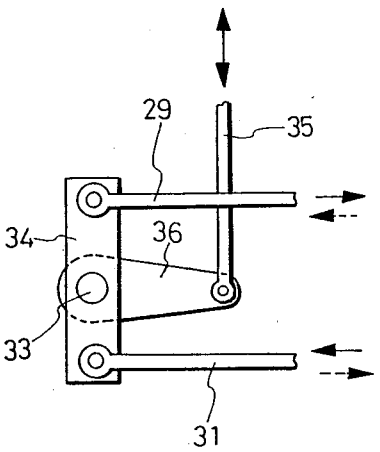
FIG. 3 is a side view showing a rod drive mechanism.

Therefore, the rods 29 and 31 for opening and closing the covers 19a and 19 move in directions opposite to each other. More specifically, as shown in FIG. 3, the rod 29 for the cover 19a and the rod 31 for the cover 19b are connected to both end portions of a lever 34 which is pivotable about a single shaft 33 as a fulcrum. The lever 34 moves integrally with a rod 35 and a lever 36 both adapted to move in the direction of arrow 35 in accordance with a bobbin change command. A spring 37 shown in FIG. 2 is located to prevent damage of the lever 36 and the like.

The construction of the covers 19a and 19b will be described below. Since both covers are symmetric In FIGS. 4 to 6, the cover body 19a is integrally formed by die casting of aluminum for example so that a vertically central portion is almost constant in sectional area, the upper portion gradually decreases in sectional area and the sectional area of the lower portion also becomes smaller downwards. The central portion, indicated at 38, covers the surface of the yarn layer on the feed bobbin. One side face of the cover 19a is formed with a mounting portion 40 for the mounting of a balloon guide 39 disposed inside the cover. The opposite side face is formed as a mounting portion 41 for the pivotable member 28.

As shown in FIGS. 1, 2, 7 and 8, the balloon guide 39, which is formed by cutting a part of a cylinder, comprises one semi-cylindrical body 42 fixed to one cover portion 19a of the opening/closing cover and the other semi-cylindrical body 43 fixed to the other cover portion 19b. A cylindrical body 44 is integrally formed above the semi-cylindrical body 43 and three blades 45, 46 and 47 are fixed onto the cylindrical body 44 toward the center. The balloon guide 39 is formed so that during travel of the yarn, the yarn passes through a gap 47 formed centrally by the blades as a balloon throttling portion, while when a yarn end in the central bore of the bobbin is blown up, the yarn easily passes through a large interblade gap 48. 50 are formed in the central portions of the covers 19a and 19b, that is, in the portions which cover the yarn layer portion of the bobbin. A transparent member is fixed to each said window so that the residual yarn can be seen from the exterior during the winding operation.

During winding of the yarn in the device of the above construction, as shown in FIGS. 1 and 9, the yarn being unwound at high speed is located inside the covers 19a and 19b, so that the fluff formed with unwinding of the yarn is sucked into the pipe 3 through a suction pipe 51 connected to the cover 20 which covers the upper tenser portion as shown in FIG. 9, and thereby removed without scattering. At the time of bobbin replacement, the covers 19a and 19b open to the dashdouble dot positions in FIGS. 2, thereby permitting easy replacement of bobbin.

According to the present invention, as set forth above, the fluff produced by rewinding of the yarn is prevented from being scattered by the covers 19a and 19b which cover the yarn feed bobbin.

The following is an explanation about the case where a balloon guide is provided outside the covers 19a and 19b.

Embodiments in which a balloon guide is provided outside of the covers 19a and 19b will be described hereinafter.

Where the take-up rate of the winder is high, the conventional types of balloon guides are insufficient at the point of the formation of balloon. When the yarn layer on the feed bobbin decreases and in this condition the yarn is rewound from the lower yarn layer of the bobbin, a large rewinding tension will be imposed on the yarn, which may cause breakage of the yarn or slip-off of a part of the yarn layer called sloughing.

To resolve the inconvenience it is preferred to use a balloon guide of the present invention. The balloon guide is formed with a tapered throttling portion in a predetermined internal position of a cylindrical body.

An embodiment of the balloon guide of the present invention will be described hereinunder with reference to the drawings.

Figure 14:
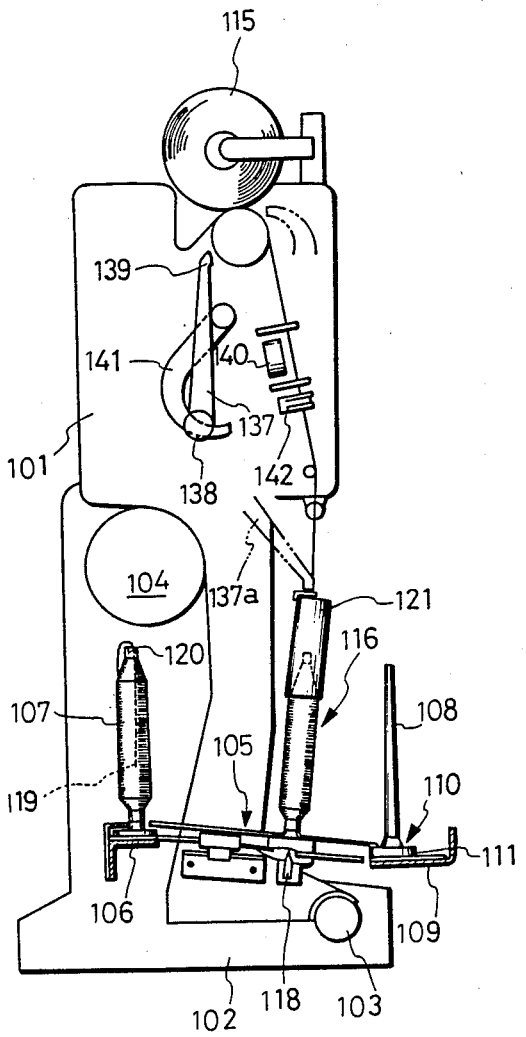
FIG. 14 is a schematic side view showing an example of construction of a winding unit.

FIG. 14 shows an example of a winding unit. This embodiment is applied to a winder of the type wherein bobbins 107 are fitted on coveying trays 110 separately from one another and in this state they are supplied to winding units. But it goes without saying that the invention is also applicable to a winder of the type wherein each winding unit has a magazine and bobbins are supplied to the magazines from a conveyor laid along the winding units.

In FIG. 14, a winding unit 101 is supported pivotably by a pivot shaft 103 of a side frame 102. During operation of the automatic winder, the winding unit 101 is also placed on and suitably fixed to a suction pipe 104. The winding unit 101 is provided with a spinning bobbin supplying device 105 in a lower position. The spinning bobbin supplying device 105 has inclination toward the front of the machine frame. It functions to receive a new spinning bobbin 107 from a spinning bobbin supplying conveyor belt 106 disposed along the back of the machine frame and discharge an empty bobbin 108 after the completion of winding of yarn to a package in the take-up position onto an empty bobbin discharging conveyor belt 109. Each bobbin is fitted upright on a tray 110 as an independent and separated conveyance medium. The tray 110 comprises a disc-like base 111 and a peg 112 projecting centrally from the base 111. A conduit communicating with an upper air passing port 113 is provided, extending to the lower surface of the base. A take-up position is determined at a suitable part of the spinning bobbin supplying device 105 and in this position the yarn on the spinning bobbin is wound up to a package 115. A pressurized air conduit communicating with a pressure source (not shown) is disposed under the take-up position of the bobbin supplying device 115 where a bobbin 116 lies, and a nozzle 118 at the tip end thereof is opposed to the conduit in the tray 110. As shown in FIG. 14, a front yarn end 119 of a new spinning bobbin 107 hangs down through the interior of a take-up tube 120.

Over the top of the bobbin 116 located in the take-up position there is supported a cylinder 121 to the winding unit 1 by means of a support member on the same virtual axis as the bobbin 116.

Figure 10:
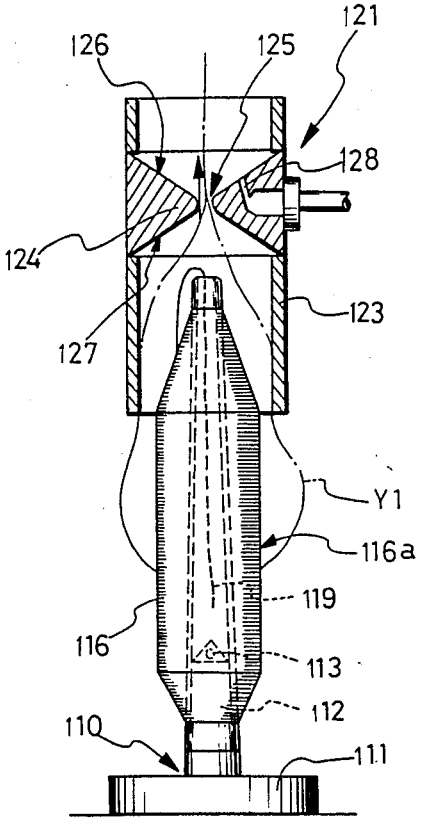
FIG. 10 is a sectional front view showing a first embodiment of a balloon guide of the present invention.
Figure 11:
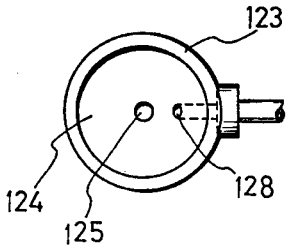
FIG. 11 is a plan view thereof.

FIGS. 10 to 13 illustrate embodiments of the above cylinder or a balloon guide 121, of which FIGS. 10 and 11 illustrate a first embodiment wherein the balloon guide 121 is of an integral construction of a cylindrical body 123 and a throttle member 124 is fixed in the interior of the cylindrical body.

The throttle member 124 comprises a central, yarn passing hole 125 and upper and lower tapered surfaces 126 and 127. As the case may be, a pressurized air injection nozzle 128 is formed in the upper tapered surface 126 of the throttle member. At the time of yarn joining operation, the yarn end 119 in the central bore of the bobbin is blown upward by the air ejected from the nozzle in FIG. 13 positioned under the tray, and is sucked and held by a stand-by relay pipe.

The cylindrical body 123 extending below the throttle member 124 of the balloon guide 121 is set to a length sufficient to fit on the bobbin 116 in the rewinding position. In the normal winding state the yarn which is unwound from the bobbin travels upward while ballooning. In this case, the balloon expands in the presence of the throttle member 124 and the angle between the yarn being unwound and the yarn layer surface, namely, the angle between the axis of the bobbin and the yarn travelling direction, becomes large, thus resulting in improvement in the yarn rising performance, whereby the occurrence of sloughing and fluff can be suppressed. Further, since the cylindrical body 123 covers the upper end portion of the bobbin, even when the yarn is unwound from the lower portion of the bobbin in a decreased volume of the yarn layer, the balloon, indicated at Y1, expands and so the separation of the yarn being unwound from the yarn layer surface indicated at 116*a* can be done smoothly. Consequently, it is possible to prevent a sudden increase of tension; in other words, the breakage of yarn under increased tension as well as sloughing can be prevented until the end of unwinding of the yarn.

Figure 12:
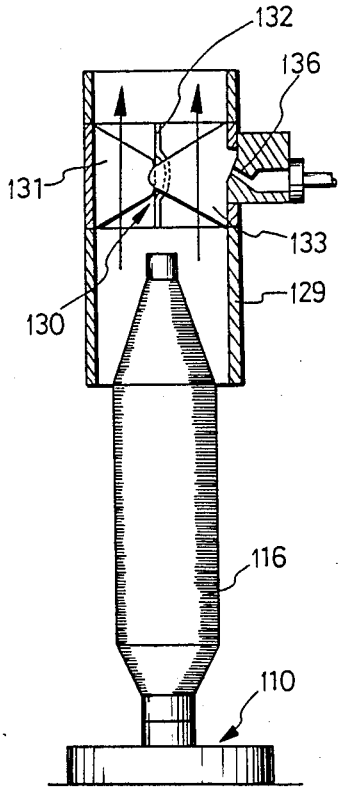
FIG. 12 is a sectional front view showing a second embodiment of the balloon guide of the invention.
Figure 13:
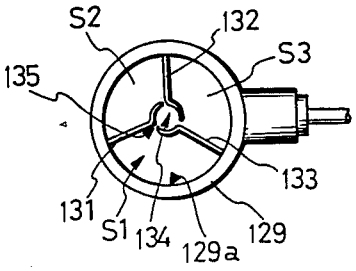
FIG. 13 is a plan view thereof.

Referring now to FIGS. 12 and 13, there is illustrated a second embodiment. In this embodiment, a cylindrical body 129 is internally formed with a throttle portion 130 which comprises a plurality of generally triangular blades 131, 132 and 133. These blades are mounted in the axial direction of the bobbin. In the drawing, three blades are disposed to form a central, yarn passing hole 134. The yarn enters the yarn passing hole 134 through and between adjacent blades. For example, in a sucked-up state of the yarn end, the yarn passes through a space Sl formed by the blades 131 and 133 and an inner peripheral wall 129*a* and is blown upward sucked and held by the relay pipe As the yarn begins to travel, it gets into the central hole 134 through a gap 135 between the blades 131 and 133 under the action of its ballooning which is in a clockwise direction in FIGS. 12 and 13, and thus the winding unit assumes the normal winding state. Also in this embodiment an auxiliary air nozzle 136 is open into the cylindrical body 129, which nozzle is effective in the case of a thick yarn and when the distance between the upper end portion of the bobbin and the lower end portion of the cylindrical body 129 is large.

Further, in the foregoing first embodiment (FIG. 10), the cylindrical body has the tapered surface 127 above the bobbin, so this throttled portion can be an obstacle to the blowing-up of the yarn and 119 and to the passing of fluff. This point is overcome in the second embodiment (FIG. 12) and since there are formed large spaces S1, S2 and S3 between adjacent blades, the blowing-up of the yarn end and the passing of fluff during take-up are effected extremely smoothly and balloon is throttled by the throttle portion 130. Thus, the same effect as in the first embodiment is exhibited.

In FIG. 14, the numeral 137 denotes a relay pipe, which is supported pivotably about a hollow shaft 138. The relay pipe 137 has a tip end formed as an opening 139 for sucking the yarn end from the bobbin, and the hollow shaft 138 is connected to a suction device (not shown). When the relay pipe pivots and the bobbin yarn end suction port 139 approaches the top of the bobbin 116 located in the take-up position, suction is effected for the yarn end. Numeral 140 denotes a yarn joining device, numeral 141 denotes a suction mouth on the package side, and numeral 142 denotes a slub catcher. In supplying the bobbin on the tray 110 to the rewinding position in the winding unit, as shown in FIGS. 10 and 12, the cylindrical body 121 as a bisplit cylindrical body opens along the center thereof to take in the bobbin to the rewinding position. Alternatively, the balloon guide may be retracted upwards.

In the present invention, as set forth above, since a balloon guide having a cylindrical body and a throttle portion is disposed to cover the upper portion of a yarn feed bobbin, the formation of the balloon is improved and, thus it is possible to prevent a sudden increase of tension and sloughing even when the yarn layer decreases in volume.

What is claimed is:

1. A device for guiding the ballooning of yarn drawn from a yarn feed bobbin in a winding unit, the device comprising:

a cylindrical body defining an upper end, a lower end and an interior surface, and a throttle disposed in the cylindrical body between the upper end and the lower end for expanding the ballooning of the yarn, the lower end of the cylindrical body being configured to surround at least a portion of the bobbin for transmitting the expanded ballooning of yarn downward as the yarn layer of the bobbin decreases.

2. The device as claimed in claim 1, wherein the throttle comprises an upper tapered surface, a lower tapered surface and a central yarn passing hole.

3. The device as claimed in claim 2, further comprising:

a pressurized air injection nozzle formed in the upper tapered surface of the throttle, the air injection nozzle being adapted to blow a yarn end released from the bobbin upward during a yarn joining operation.

4. The device as claimed in claim 1, wherein the bobbin defines an axis and wherein the throttle comprises a plurality of substantially triangular blades mounted along the axis of the bobbin and a yarn passing hole formed between the blades at a central portion of the cylindrical body.

5. The device as claimed in claim 1, further comprising an auxiliary air nozzle-opening upward into the cylindrical body.

6. The device as claimed in claim 1, wherein the cylindrical body is provided with a vertical division to thereby enable the cylindrical body to be opened along the vertical division.

7. A device as claimed in claim 1, further comprising: a cover for the yearn feed bobbin, wherein the throttle and the cylindrical body are disposed within the cover.

8. The device as claimed in claim 7, wherein the cover comprises a pair of pivotally mounted cover members movable between an open position and a closed position.

9. The device as claimed in claim 8, wherein the cover members define a substantially rectangular shape in the closed position.

* * * * *